US007849637B2

(12) United States Patent
Lowe

(10) Patent No.: US 7,849,637 B2
(45) Date of Patent: Dec. 14, 2010

(54) FOLD-UP SCAFFOLD FOR SEMI-TRAILER SHOP

(76) Inventor: Erwin Lowe, 582 Paragon Pkwy., NW., Cleveland, TN (US) 37312

( * ) Notice: Subject to any disclaimer, the term of this patent is extended or adjusted under 35 U.S.C. 154(b) by 858 days.

(21) Appl. No.: 11/783,423

(22) Filed: Apr. 9, 2007

(65) Prior Publication Data

US 2007/0235258 A1 Oct. 11, 2007

Related U.S. Application Data

(60) Provisional application No. 60/789,914, filed on Apr. 7, 2006.

(51) Int. Cl.
*E04B 7/16* (2006.01)

(52) U.S. Cl. ..... 52/69; 52/66; 52/71; 182/131; 182/143

(58) Field of Classification Search ..... 52/64, 52/69, 71, 73, 66, 70, 650.3; 182/130, 131, 182/143, 1
See application file for complete search history.

(56) References Cited

U.S. PATENT DOCUMENTS 2,284,035 A * 5/1942 Blair ..... 171/16
3,217,155 A * 11/1965 Caferro et al. ..... 362/150
4,013,140 A * 3/1977 Pradon ..... 182/1
4,679,657 A * 7/1987 Bennett et al. ..... 182/113
5,042,612 A * 8/1991 Bennett et al. ..... 182/1
5,400,551 A * 3/1995 Uhl ..... 52/68
5,671,823 A * 9/1997 Oakes ..... 182/36
2006/0054392 A1 * 3/2006 MacDonald et al. ..... 182/113

* cited by examiner

*Primary Examiner*—Richard E Chilcot, Jr.
*Assistant Examiner*—William V Gilbert
(74) *Attorney, Agent, or Firm*—Miles & Stockbridge P.C.; David R. Schaffer, Esq.

(57) ABSTRACT

Embodiments of the present invention are directed to a fold-up scaffold system that includes multiple spaced vertical beams supported at one end on a floor of a building and scaffold sections extending across the vertical beams. The system also includes means at opposite ends of the scaffold sections for pivotally supporting the scaffold sections to the vertical beams and at least two air cylinders for each scaffold section connected between the scaffold sections and the vertical beams. In addition, each of the at least two air cylinders is adapted to be actuated between a lowered and a raised position, the scaffold sections being pivoted away from the vertical beams when the at least two air cylinders are actuated to the lowered position to provide a substantially horizontal surface and is positioned substantially vertically against the beam when the at least two air cylinders are actuated to the raised position.

20 Claims, 17 Drawing Sheets

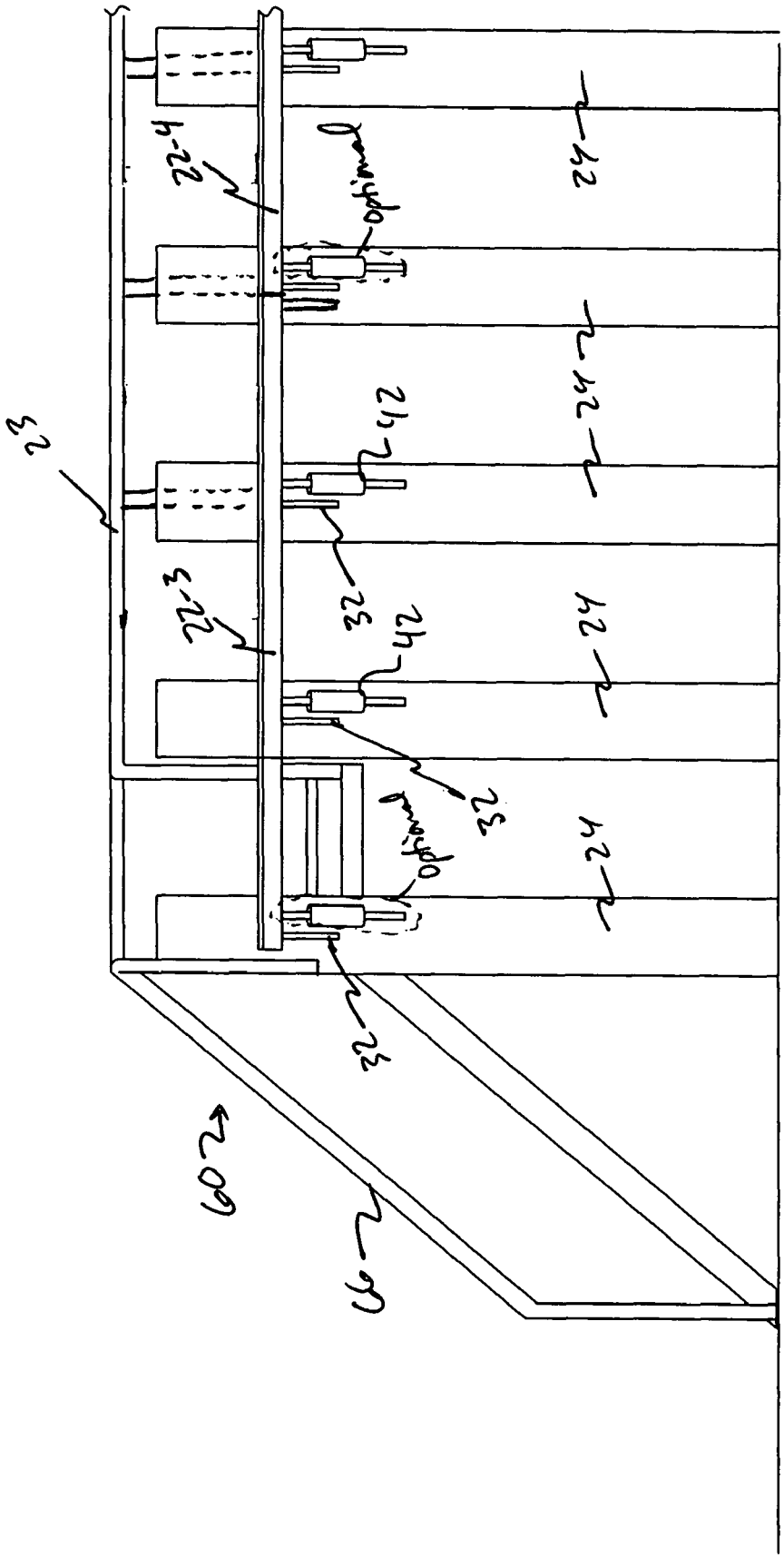
42
42
42
42
42
22-4
22-3
22
22
22

C/S-2 PLATFORM SECTION AT ENDS

SCALE: 3/4"=1'-0"

2/S-2 COLUMN AT PLATFORM ENDS

SCALE: 3/4"=1'-0"

FOLD-UP SCAFFOLD FOR SEMI-TRAILER SHOP

CROSS-REFERENCE TO RELATED APPLICATION

This application claims benefit of priority to U.S. Provisional Patent Application Ser. No. 60/789,914, filed on Apr. 7, 2006, and which is incorporated herein in its entirety.

FIELD OF THE INVENTION

This invention relates to semi-trailer shops and more particular to a scaffold for a semi-trailer shop which facilitates maintenance of lights, roof patches and other overhead repairs to the upper section of a building, while allowing tall semi-trailers and large trucks to be driven into the building. This invention also facilitates repair to vehicles by pivoting the scaffold to a horizontal position to provide a horizontal walking or working platform over the roof of the vehicle.

BACKGROUND OF THE INVENTION

In large buildings such as semi-trailer shops where maintenance may be conducted on semi-trailers or trucks, maintenance on the inside roof and upper portions of such building is usually conducted by providing extension ladders to enable workers to reach the inside ceiling and high areas within the building for pipe replacements, repair of roof leaks, light bulb replacement and other maintenance problems. Because of the height of such buildings, use of such ladders can create a dangerous situation due to height extensions. Further, the ladders frequently interfere with truck or trailer entry into the building and must be moved from one section to another. This increases substantially the length of time necessary to conduct ordinary repairs.

These disadvantages are overcome by the present invention in which foldable scaffolds are provided in relatively long sections. The scaffolds are positioned on opposite sides of a work bay, approximately ten feet six inches from the floor of the building. The scaffolds can be pivoted from a vertical stored position to a horizontal position to provide a walking surface for maintenance purposes. Scaffolds provided on each side of the bay may be connected by transverse walking platforms that may be spaced such that a semi-trailer or large truck can be driven into the bay between the scaffolds.

In accordance with a feature of the invention, a walking surface comprises several longitudinal sections of scaffolding. Each section is supported by an 8 inch H beam bolted into 4×4 concrete piers onto the surface floor of the building. Several longitudinal sections may be connected to make up one continuous walking surface that extends the length of the bay.

The use of scaffolding according to the invention provides several advantages including safety, convenience, time saving, prevention of damage to trailers, avoidance of the necessity to use messy hydraulic fluid devices which frequently cause spillage on floors, avoidance of stationary braces and obstacles to work around.

In accordance with the present invention, the fold-up scaffolds can be pivoted from a vertical storage position which allows access of semi-trailers into a bay to a substantial horizontal position, parallel to the floor. The scaffold can be pivoted downward at an arc of 85° to 90° to provide an elongated, horizontal walking surface for working on the tops of trucks and semi-trailers for the replacement of lights or conducting other maintenance procedures while avoiding use of obstructing ladders and dangers inherent thereto.

BRIEF DESCRIPTION OF THE DRAWINGS

The subject invention is illustrated in the attached drawings wherein like characters represent like elements throughout the several views.

FIG. 7 is a front view of the invention with the platform in the lowered position, in accordance with an embodiment of the present invention.

DETAILED DESCRIPTION

Figure 1:
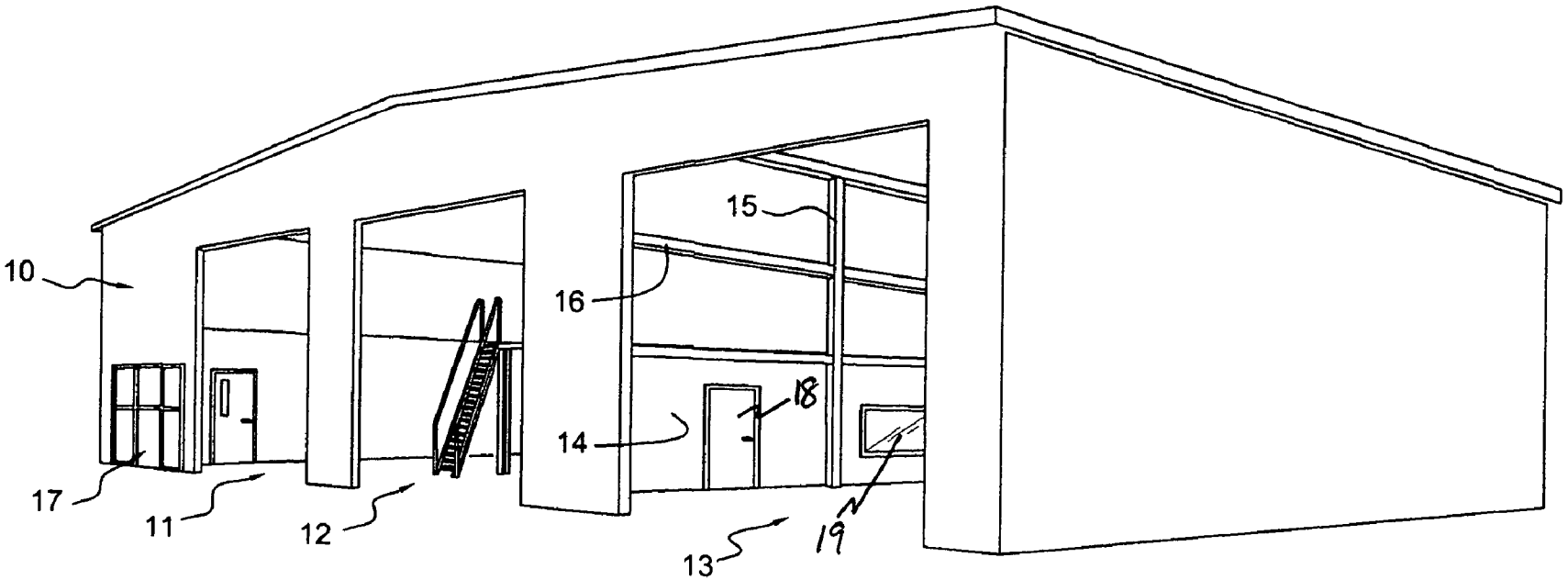
FIG. 1 is a perspective view of a three bay semi-trailer shop, in accordance with an embodiment of the present invention.

Referring now to the figures, the present invention will be described. FIG. 1 is a perspective view of a three bay semi-trailer shop, in accordance with an embodiment of the present invention. In FIG. 1, a semi-trailer shop 10 may include multiple elongated bays, for example, first, second and third elongated bays 11, 12 and 13, respectively, where each is adapted to receive a semi-trailer. Each bay may extend up to 60 feet or more and may be open to each other as in bays 11 and 12, or may include a solid and/or semi-solid wall 14 extending along the length of and between bays 12 and 13. Although the invention is described in connection with a semi-trailer shop having extended bays in excess of 60 feet, the invention is adapted for use in bays of shorter dimensions. Generally, a typical bay for a semi-trailer shop is in excess of sixty feet. Each bay may be compartmentalized with wall 14 extending the length thereof and having vertical 15 and horizontal 16 supporting beams for strength. Wall 14 may also include one or more doors 18 and/or windows 19 to permit transit and/or communication between bays. For convenience, shop 10 may also include a control area or office 17 that may be integral with, separate from and/or attached to shop 10.

Figure 2:
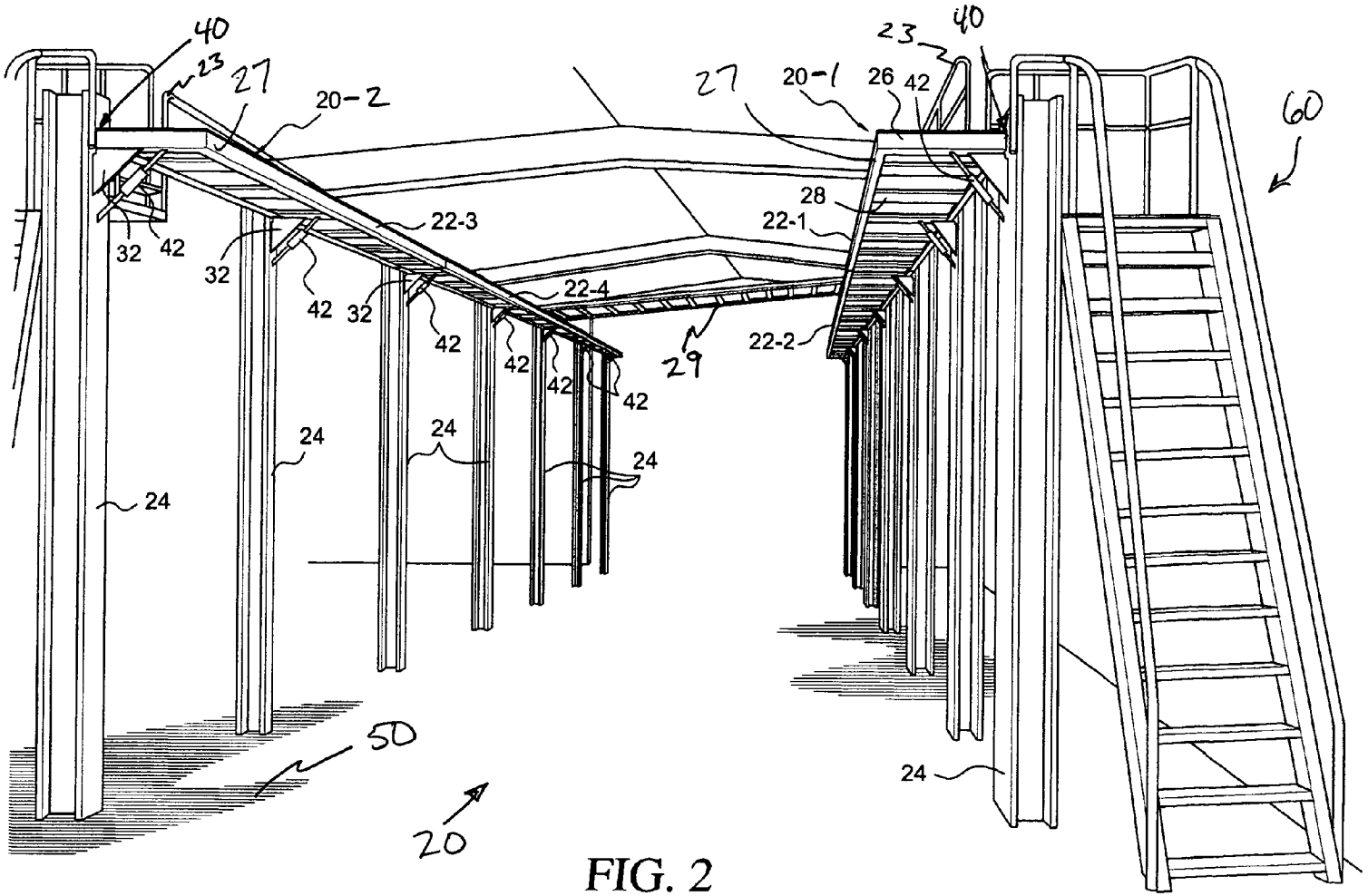
FIG. 2 is a view of the interior of one of the bays of the trailer shop showing a fold-up scaffold installed therein, in accordance with an embodiment of the present invention.

FIG. 2 is a view of the interior of one of the bays of shop 10 in which a fold-up scaffold is installed, in accordance with an embodiment of the present invention. In FIG. 2, a fold up scaffold 20 may include two substantially parallel halves, a right half 20-1 and a left half 20-2, where each half may have one or more sections 22-1, 22-2 or 22-3, 22-4, respectively, of approximately thirty foot lengths on each side of a bay. As shown in the embodiment in FIG. 2, right half 20-1 includes a pair of sections 22-1, 22-2 on the right-side and left half 20-2 contains another pair of sections 22-3, 22-4 on the left-side, and each pair is serially arranged on each side to provide a 60 foot long walkway extending almost the entire length of each side of the bay. Associated with a back side of each section is a handrail section 23 for safety. The scaffolds are positioned at a height to enable easy access to the top and upper sides of a semi-trailer, for example, but not limited to, a height of approximately ten feet six inches from the floor to the top of platform 29, with one on each side of the bay. Alternative embodiments are contemplated in which the top of platform 29 of each scaffold may be positioned higher and/or lower than ten feet six inches from the floor to accommodate semi-trailers and/or trucks with greater and lower roof heights. Each section 22-1, 22-2, 22-3, 22-4 is attached to a series of spaced vertical H beams 24 that are mounted to the floor of the shop. Generally, each H beam 24 is fastened to floor 50 either by being bolted into a 4×4 concrete pier 52 under the surface of floor 50 (see detail in FIG. 3) or by being bolted directly to floor 50.

In FIG. 2, each scaffold section 22-1, 22-2, 22-3, 22-4 comprises an approximately 24 inch by 30 foot rectangular frame 26 that includes a back piece 25 and a front piece 27, both of which are approximately 30 feet in length and connected by multiple internal parallel strengthening cross bars 28 of approximately 24 inches. Back piece 25, front piece 27 and cross bars 28 may be made from L-shaped and/or C-shaped angle iron having a height of approximately 3 inches. The cross bars 28 may be spaced approximately 24 inches apart along the length of the front and back pieces and at opposite ends to complete the rectangular frame 26. A solid and/or open grid platform 29 may be disposed on the top surface of rectangular frame 26 to form each of the sections 22 and affixed thereto in a suitable manner. Transverse platforms or planks 29 may be utilized to provide a walking surface to cross between each half.

In FIG. 2, means 40 are provided at least at opposite ends of the sections 22-1, 22-2, 22-3, 22-4 to permit pivoting of the sections 22 from a storage position resting vertically upwardly against the H beams 24 to a horizontal position as shown in FIG. 2. Means 40 may also be provided to attach each of the sections to some or all H beams located between the opposite ends of the sections 22-1, 22-2, 22-3, 22-4. Means 40 may be in the form of a hinge 40 on each H beam and that may permit each section 22-1, 22-2, 22-3, 22-4 to pivot upwardly and downwardly. Alternatively, means 40 may be in the form of a gusset 32 bolted or welded at one end to the end piece of a section 22-1, 22-2, 22-3, 22-4. The other end of the gusset 32 is adapted to ride a guide surface mounted to the H beam. Other mechanical arrangements for pivoting the scaffold sections may also be used, for example, the end pieces of sections 22-1, 22-2, 22-3, 22-4 or the gussets may include stub shafts journaled into a cooperating race in which the shaft rotates. The stub shafts may be mounted to the H beam and cooperate with gussets 32, which may have a race that surrounds the shaft. As should be apparent.

Figure 11:
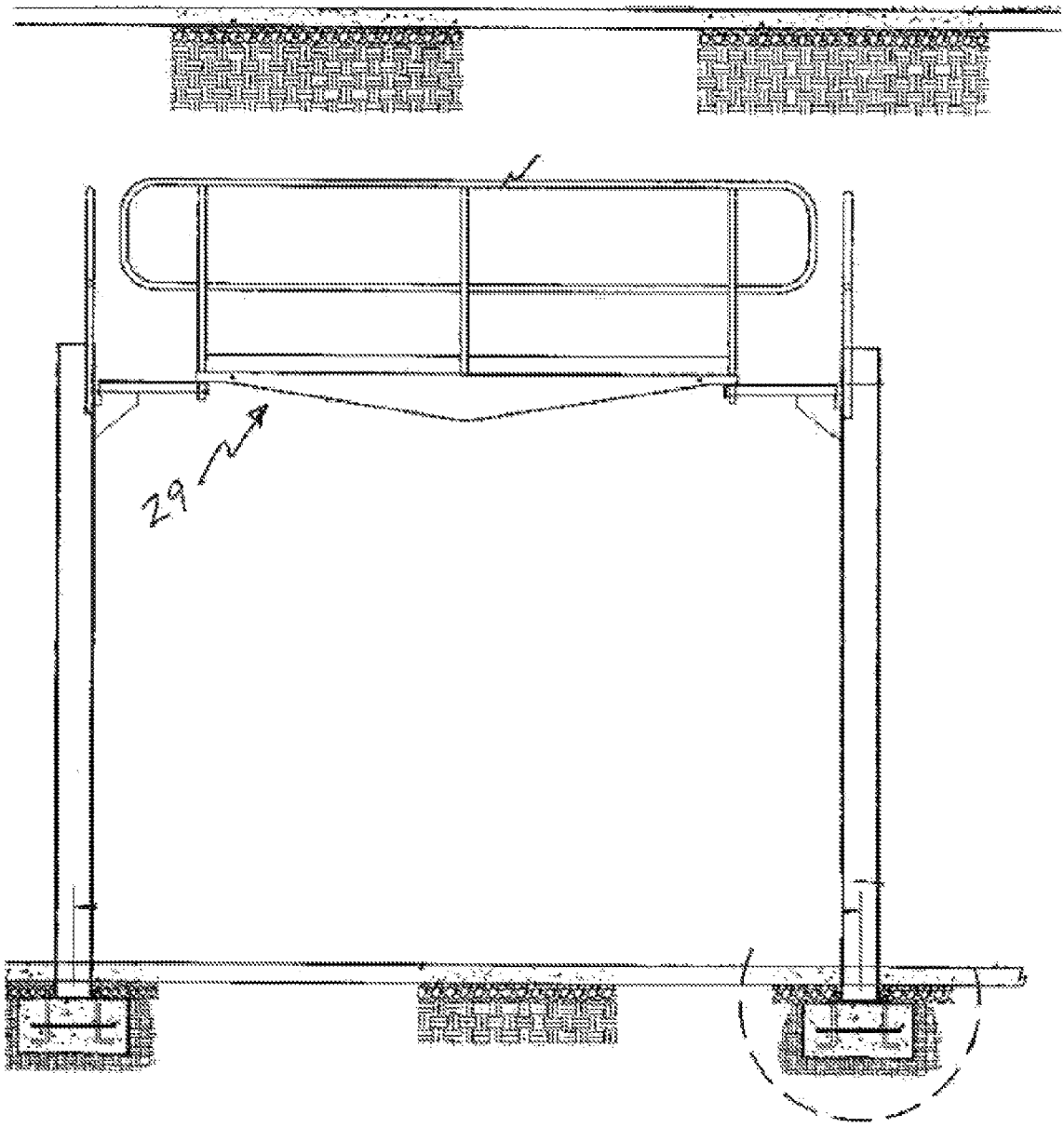
FIG. 11 is a front view of a bridge with safety handrail shown position between scaffold sections, in accordance with an embodiment of the present invention.
Figure 12:
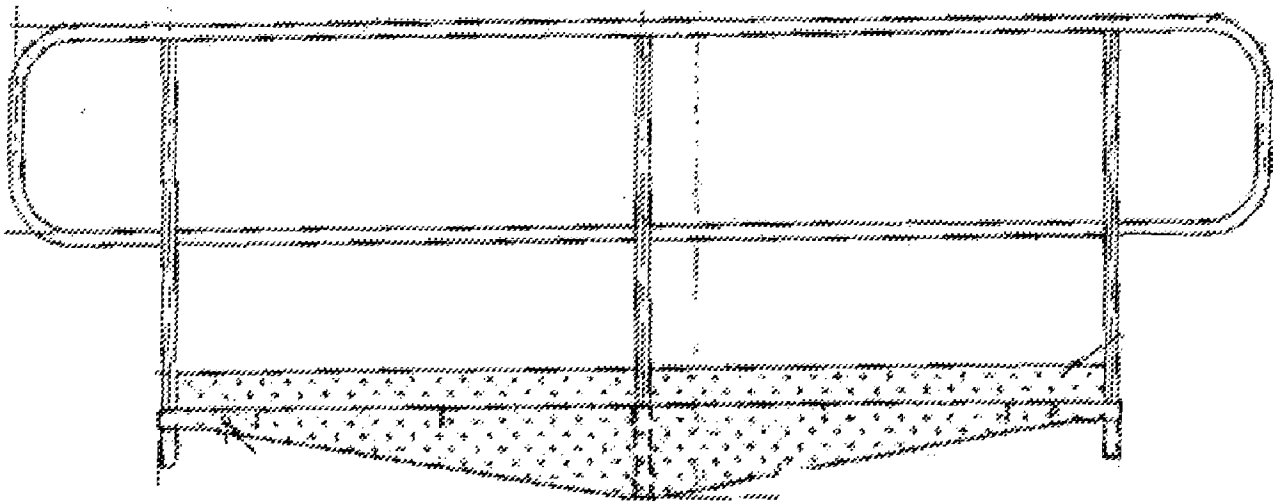
FIG. 12 is a detailed front view of a bridge with safety handrail, in accordance with an embodiment of the present invention.
Figure 13:
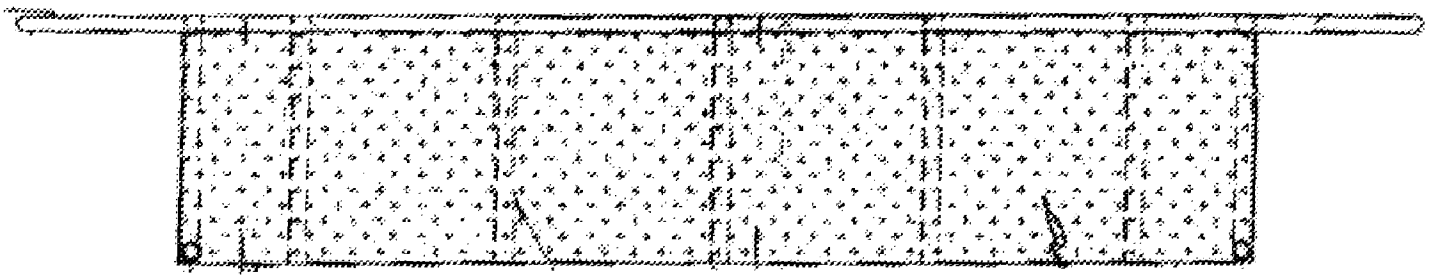
FIG. 13 is a top view of a bridge with safety handrail, in accordance with an embodiment of the present invention.

In FIG. 2, multiple air cylinders 42 are connected to the underside of each scaffold frame and to the H beams. Each air cylinder 42 is pivotally supported on a single H beam 24 and is activated by an air control valve (not shown) to cause, in cooperation with the other air cylinders 42 associated with the same scaffold section, to raise the corresponding scaffold section to a substantially vertical position against the H beam 24 or retract it to an extended position. In the extended position, scaffold section 22-3 is in a horizontal work position. When the air cylinders are deactivated, the air cylinders draw the scaffold section downward to their horizontal position so that the back piece 25 and a back edge of gusset 32 rest against the H beams 24. The space between the right half 20-1 and left half 20-2 of the scaffold is such as to permit a semi-trailer or truck to be driven into the bay between the downwardly supported scaffolded sections. The height of the scaffold section when extended vertically is such as to permit a trailer to be driven beneath and/or between the scaffold sections. One or more bridges and/or planks 29, for example, a bridge as shown in FIGS. 11, 12 and 13 may extend between the scaffold sections and be suitably anchored at their ends by conventional anchoring and/or latching means to allow workers to pass from one side to the other and provide access to the entire area between opposed scaffold sections in a bay. Preferably, the anchoring or latching means are of a quick release type to enable planks to be moved laterally along the scaffold sections with minimum effort. Alternatively, a chain hoist, either with or without a motor, may be attached to each bridge to permit the bridge to be raised up and away from the scaffold sections toward and stored near the ceiling of the building when it is not in use.

Figure 3:
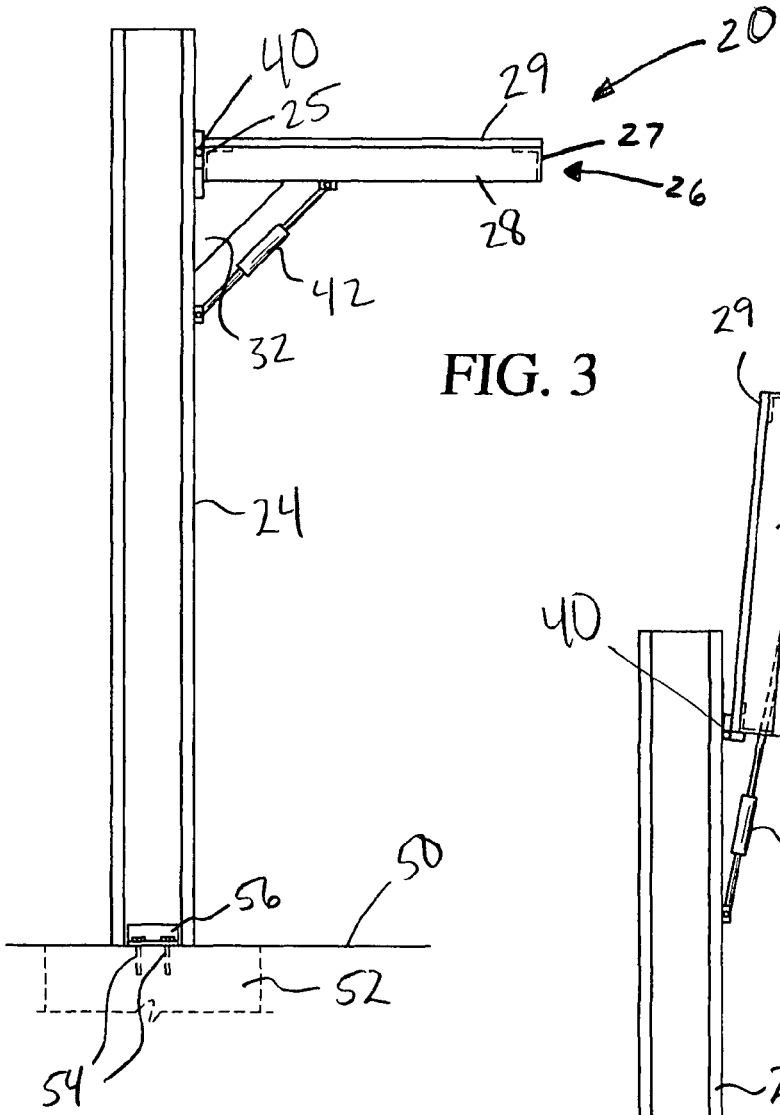
FIG. 3 is a side view of the invention with the platform in the lowered position, in accordance with an embodiment of the present invention.

FIG. 3 is a side view of the invention with the platform in the lowered position, in accordance with an embodiment of the present invention. In FIG. 3, H beam 24 is shown bolted to a concrete pier 52 either above or below the surface of the floor 50. However, it could readily be appreciated that in an existing building, the scaffolds may be retrofitted in which case each H beam can be installed on the floor surface by drilling through a base plate 56 and into the concrete pier 52 and using anchor pins 54. As seen in FIG. 3, scaffold 20 is in the lowered, horizontal position with air cylinder 42 in its deactivated position, and gusset 32 in contact with a block 59 and H beam 24 to support scaffold 20. Frame 26 includes an end strengthening cross bar 28, back piece 25 (shown in hidden line) and front piece 27 (shown in hidden line), and platform 29 affixed to a top side of frame 26. A pivoting means 40 for example, but not limited to, a hinge, pivotally connects frame 26 via back piece 25 to each H beam 24.

Figure 4:
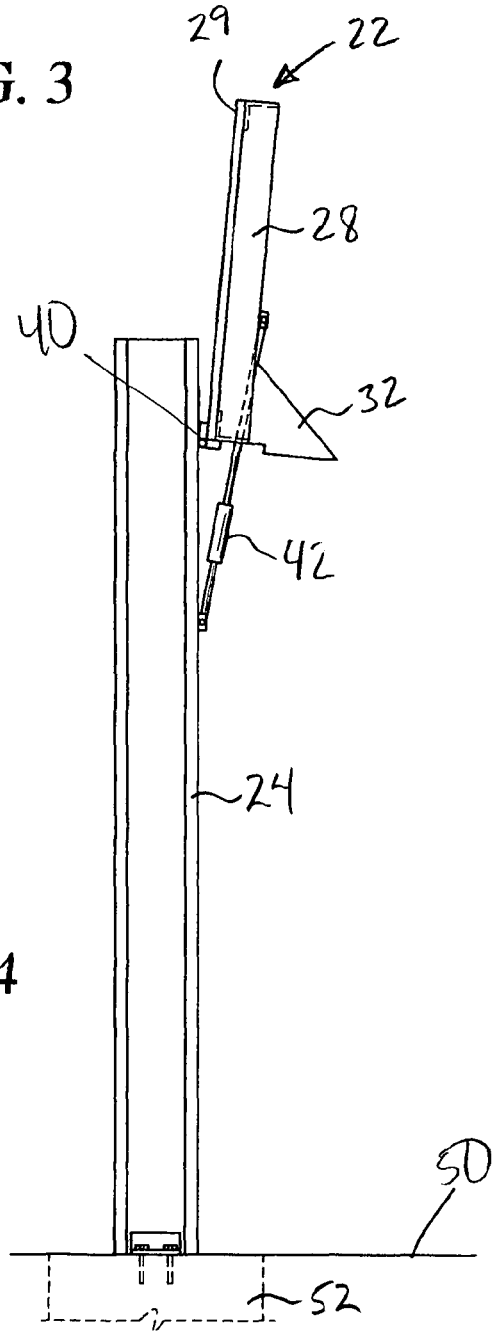
FIG. 4 is another side view of the invention with the platform in the raised position, in accordance with an embodiment of the present invention.

FIG. 4 is another side view of the invention with the platform in the raised position, in accordance with an embodiment of the present invention. In FIG. 4, scaffold 20 with gusset 32 is in the raised, vertical position with air cylinder 42 in its activated and extended position and gusset 32 no longer in contact with H beam 24.

Figure 5:
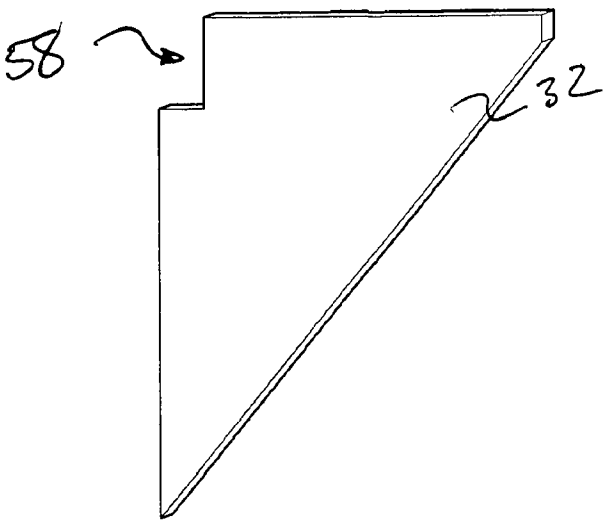
FIG. 5 is a side perspective view of a gusset, in accordance with an embodiment of the present invention.

FIG. 5 is a side perspective view of a gusset, in accordance with an embodiment of the present invention. In FIG. 5, gusset 32 has a substantially right-triangular shape with a notch 58 in the right-angle corner sized to provide clearance for pivoting means 40, as seen in FIGS. 3 and 4, when scaffold 20 is in the lowered, horizontal position.

Figure 6:
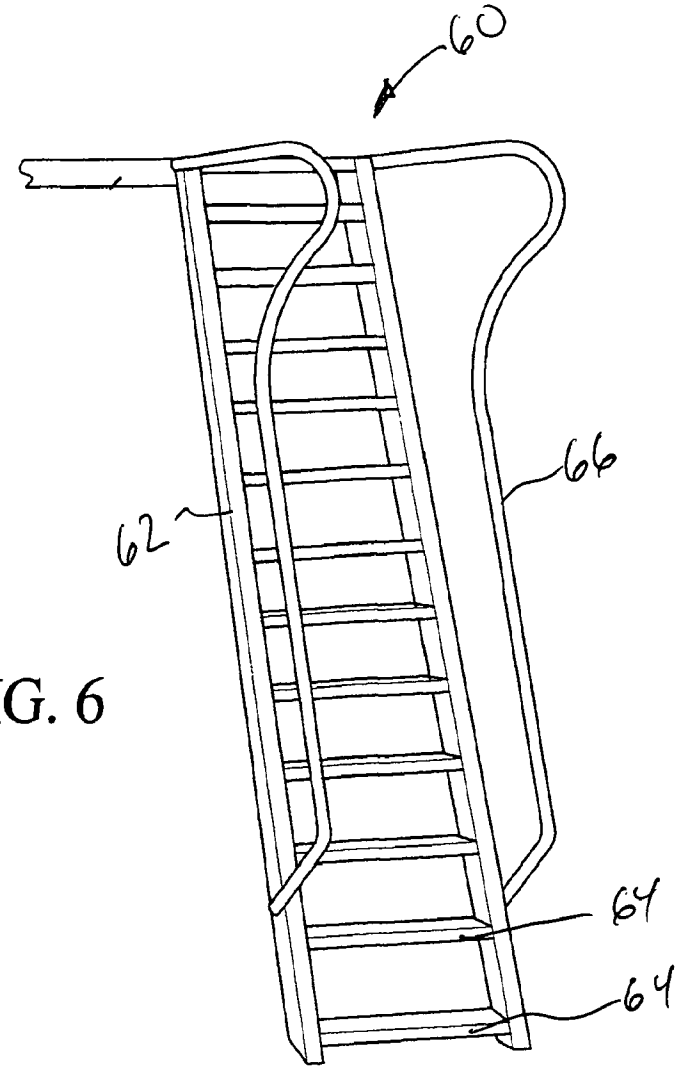
FIG. 6 is a front perspective view of a stair system for accessing the platform, in accordance with an embodiment of the present invention.

FIG. 6 is a front perspective view of a stair system for accessing the platform, in accordance with an embodiment of the present invention. In FIG. 6, a stair system 60 includes at least two sides 62 spaced apart by multiple steps 64 and a pair of substantially symmetrical handrails 66 extending from equivalent points near a lower end of each of sides 62 and extending to a top end of each of sides 62.

FIG. 7 is a front view of the invention with the platform in the lowered position, in accordance with an embodiment of the present invention. In FIG. 7, air cylinders 42 and gussets 32 are shown slightly off-set to provide clearance when the scaffold sections 22-1, 22-2, 22-3, 22-4 are raised and lowered.

Figure 8:
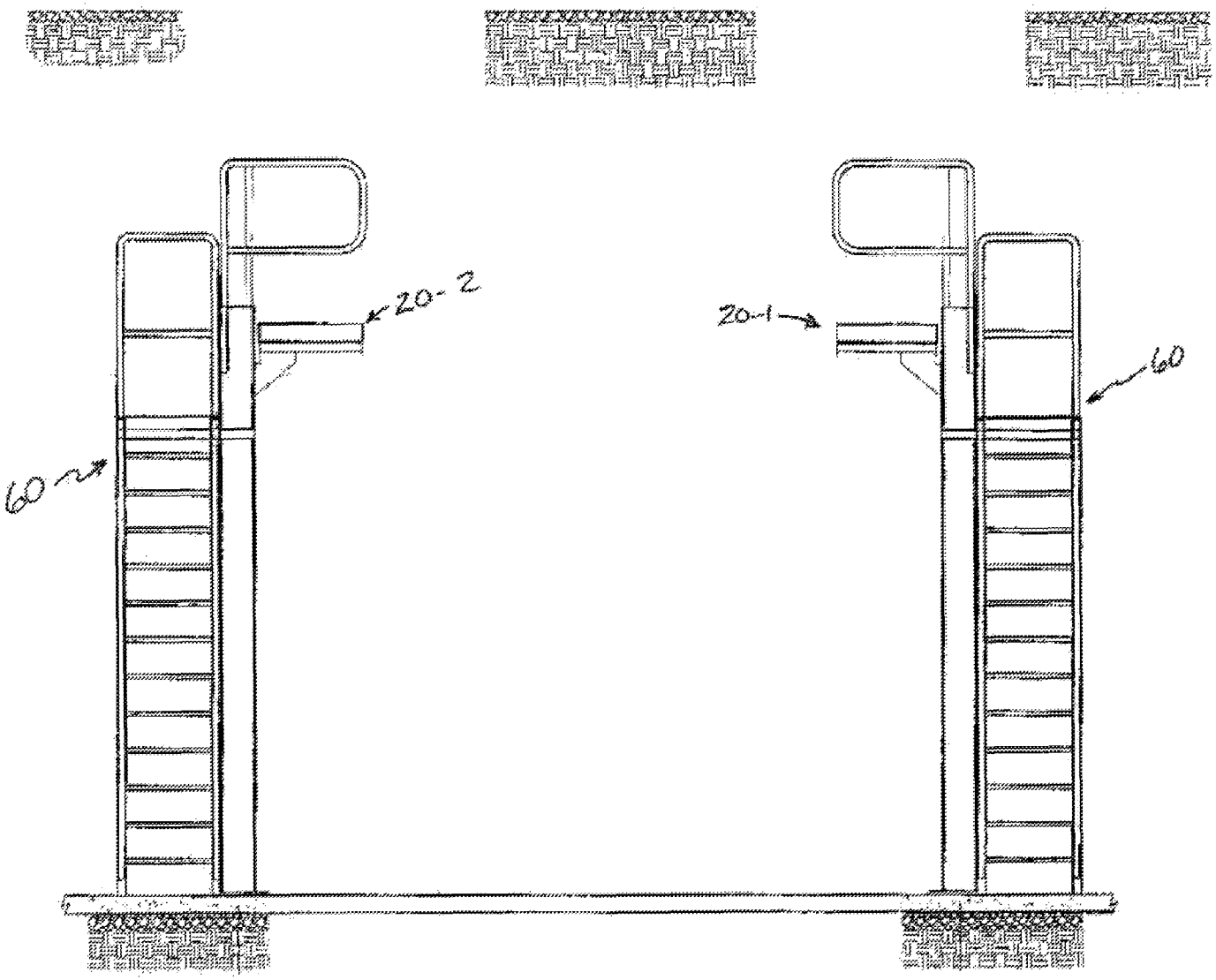
FIG. 8 is a stair system side view of a fold-up scaffold, in accordance with an embodiment of the present invention.

FIG. 8 is a stair system side view of a fold-up scaffold, in accordance with an embodiment of the present invention. In FIG. 8, both sides of the fold-up scaffold system 20-1, 20-2 are shown with their respective stair system.

Figure 9:
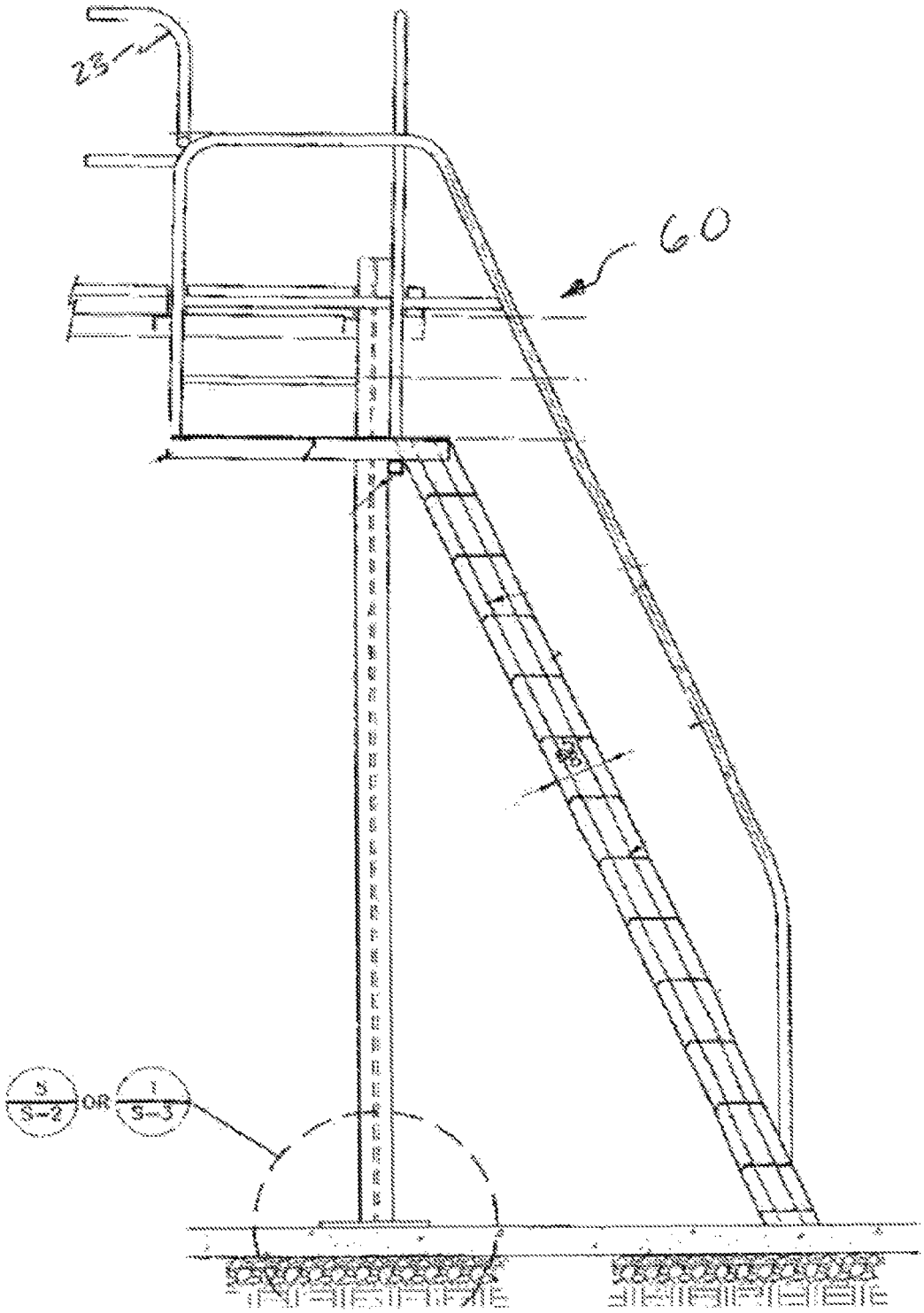
FIG. 9 is a side view of a stair system for accessing the platform, in accordance with an embodiment of the present invention.

FIG. 9 is a side view of a stair system for accessing the platform, in accordance with an embodiment of the present invention.

Figure 10:
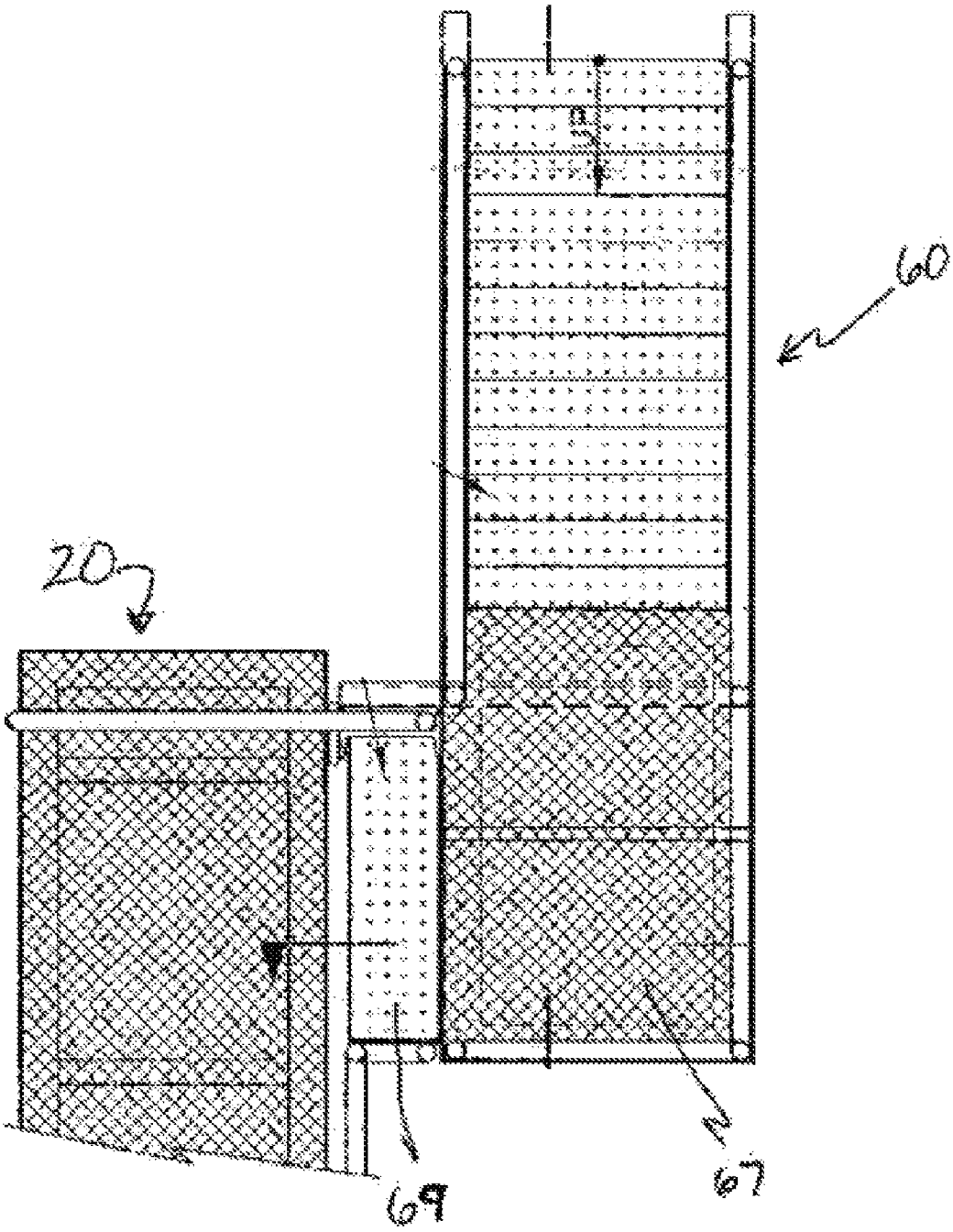
FIG. 10 is a top view of a stair system for accessing the platform, in accordance with an embodiment of the present invention.

FIG. 10 is a top view of a stair system for accessing the platform, in accordance with an embodiment of the present invention. In FIG. 10, a step 69 between a landing 67 and the steps of stair system 60.

FIG. 11 is a front view of a bridge with safety handrail shown position between scaffold sections, in accordance with an embodiment of the present invention. In FIG. 11, bridge 29 may be assembled from aluminum and may include a removable handrail and hoisting hooks for lifting and positioning the bridge between two opposite scaffold sections.

FIG. 12 is a detailed front view of a bridge with safety handrail, in accordance with an embodiment of the present invention.

FIG. 13 is a top view of a bridge with safety handrail, in accordance with an embodiment of the present invention. In FIG. 13, a bridge platform 1310 may be assembled from aluminum diamond plate and/or open metal grid material.

Figure 14:
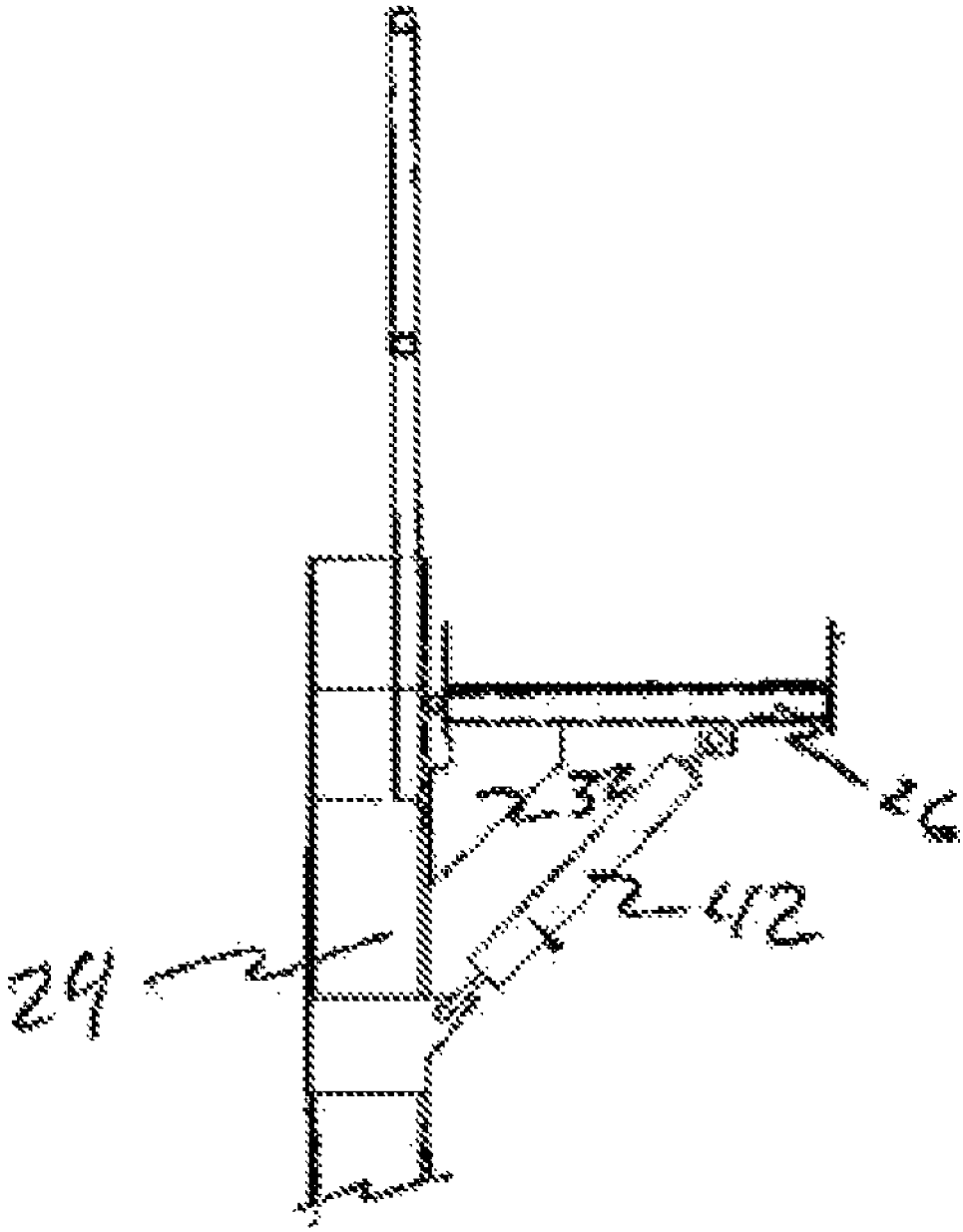
FIG. 14 is a cross-section view of a fold-up scaffold section and a non-end H beam with the platform in the lowered position, in accordance with an embodiment of the present invention.

FIG. 14 is a cross-section view of a fold-up scaffold section and a non-end H beam with the platform in the lowered position, in accordance with an embodiment of the present invention. In FIG. 14, air cylinder 42 may be a BIMBA air cylinder that is attached to H beam 24 and frame 26.

Figure 15:
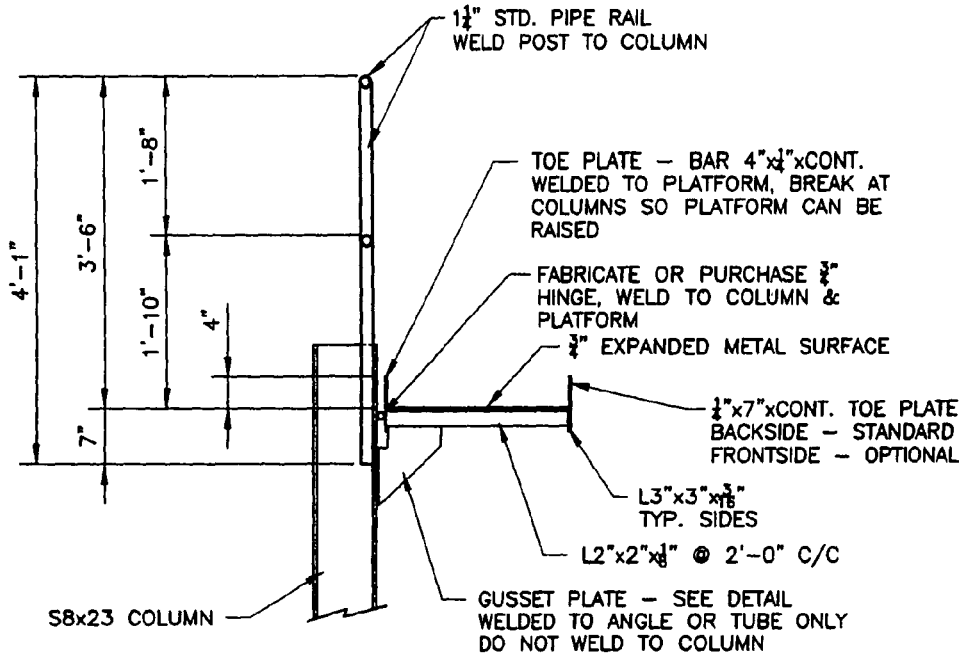
FIG. 15 is a cross-section view of a fold-up scaffold section and an end H beam with the platform in the lowered position, in accordance with an embodiment of the present invention.

FIG. 15 is a cross-section view of a fold-up scaffold section and an end H beam with the platform in the lowered position, in accordance with an embodiment of the present invention.

Figure 16:
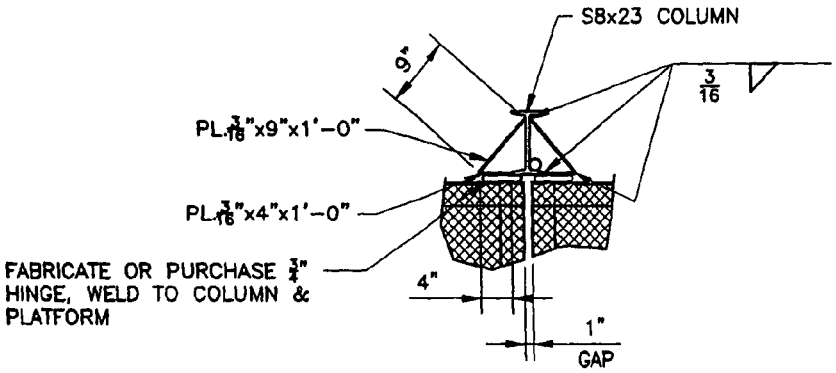
FIG. 16 is a top view of an H beam and portion of two adjacent fold-up scaffold sections with the platform in the lowered position, in accordance with an embodiment of the present invention.

FIG. 16 is a top view of an H beam and portion of two adjacent fold-up scaffold sections with the platform in the lowered position, in accordance with an embodiment of the present invention.

Figure 17:
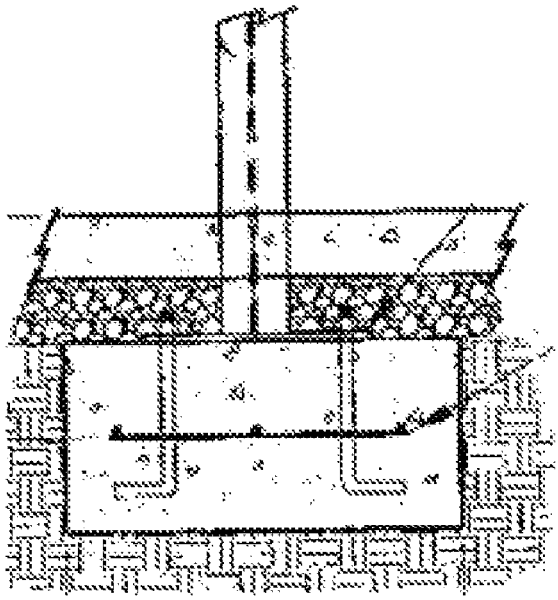
FIG. 17 is a detailed cross-section view of a base of an H beam fastened to a concrete footer below a finished floor in a building, in accordance with an embodiment of the present invention.

FIG. 17 is a detailed cross-section view of a base of an H beam fastened to a concrete footer below a finished floor in a building, in accordance with an embodiment of the present invention.

Figure 18:
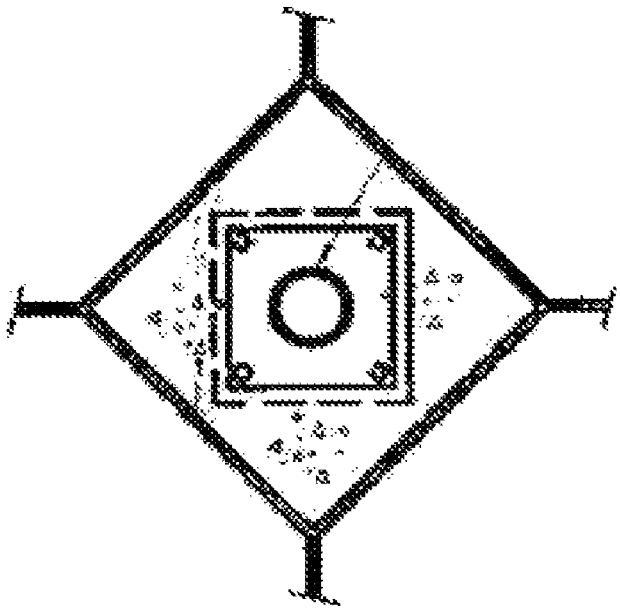
FIG. 18 is a top view of a base plate for an H beam fastened to a concrete footer below a finished floor in a building, in accordance with an embodiment of the present invention.

FIG. 18 is a top view of a base plate for an H beam fastened to a concrete footer below a finished floor in a building, in accordance with an embodiment of the present invention.

Figure 19:
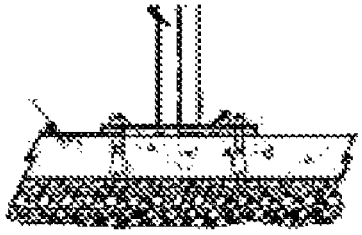
FIG. 19 is a detailed cross-section view of a base of an H beam fastened to a concrete finished floor in a building, in accordance with an embodiment of the present invention.

FIG. 19 is a detailed cross-section view of a base of an H beam fastened to a concrete finished floor in a building, in accordance with an embodiment of the present invention.

Figure 20:
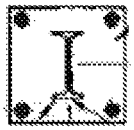
FIG. 20 is a top view of a base plate for an H beam fastened to a concrete finished floor in a building, in accordance with an embodiment of the present invention.

FIG. 20 is a top view of a base plate for an H beam fastened to a concrete finished floor in a building, in accordance with an embodiment of the present invention.

As is apparent from the above description and the figures referenced therein, there is provided a variety of embodiments of a fold-up scaffold, in accordance with the present invention. While this invention has been described in conjunction with a number of embodiments, it is evident that many alternatives, modifications and variations would be, or are, apparent to those of ordinary skill in the applicable arts. Accordingly, applicant intends to embrace all such alternatives, modifications, equivalents and variations that are within the spirit and scope of this invention.

What is claimed is:

1. A building having at least one bay adapted to having a vehicle such as truck or semi-trailer driven therein comprising a plurality of spaced vertical beams, each beam having a bottom end and a top end and supported at the bottom end on a floor of the building, at least one first scaffold section extending across at least a first two of the plurality of spaced vertical beams, at least one second scaffold section extending across at least a second two of the plurality of spaced vertical beams, the first and second scaffold sections having means on a proximal side and at opposite ends for pivotally supporting the first and the second scaffold sections respectively to the first two and the second two of the plurality of spaced vertical beams and at least two air cylinders for each of the first and the second scaffold sections connected respectively between the first and the second scaffold sections and the top end and the bottom end of the at least first two of the plurality of spaced vertical beams and the at least second two of the plurality of spaced vertical beams, each of the at least two air cylinders being adapted to be actuated between a first and a second position, a distal side of each of the scaffold sections being pivoted away from the vertical beams when the at least two air cylinders are actuated in the first position to provide a substantially horizontal surface and the distal side of each of the scaffold sections being pivoted toward the vertical beams when the at least two air cylinders are actuated in the second position to be positioned substantially vertically against the beam, and a gusset attached adjacent each of the opposite ends of the proximal side of each scaffold and depending substantially perpendicularly away from a bottom of each scaffold, each gusset engaging one of the vertical beams when the scaffold section is pivoted to the horizontal position.

2. The building as set forth in claim 1 wherein when the scaffold sections are extended vertically they provide clearance in the bay for a vehicle to be driven therein.

3. The building as set forth in claim 1 wherein each scaffold section is approximately 24 inches wide by 30 feet long.

4. The building as set forth in claim 1 wherein the means for pivotally supporting comprises a hinge.

5. The building as set forth in claim 1 wherein each scaffold section has associated therewith a hand rail affixed to the plurality of spaced vertical beams.

6. The building as set forth in claim 1 further comprising a staircase attached at a bottom end to the floor of the building and attached at a top end to one of the vertical beams and adapted to provide access to the scaffold sections.

7. The building as set forth in claim 1 further comprising another plurality of spaced vertical beams, each beam having a bottom end and a top end and aligned substantially parallel to the other plurality of spaced vertical beams and supported at the bottom end on a floor of the building, at least one another first scaffold section extending across at least a first two of the another plurality of spaced vertical beams, at least one second another scaffold section extending across at least a second two of the another plurality of spaced vertical beams, the first and the second another scaffold sections having means at opposite ends for pivotally supporting the first and the second another scaffold sections respectively to the first and the second two of the another plurality of spaced vertical beams and at least another two air cylinders for each of the first and the second another scaffold sections connected respectively between the first and the second another scaffold sections and the top end and the bottom end of the at least first two of the another plurality of spaced vertical beams and the at least second two of the another plurality of spaced vertical beams, each of the at least another two air cylinders being adapted to be actuated between a first and a second position, a distal end of each of the another scaffold sections being pivoted away from the another plurality of spaced vertical beams when the at least another two air cylinders are actuated in the first position to provide a substantially horizontal surface and the distal side of each of the another scaffold sections being pivoted toward the another plurality of vertical beams when the at least another two air cylinders are actuated in the second position to be positioned substantially vertically against the another plurality of vertical beams, and another gusset attached adjacent each of the opposite ends of the proximal side of each another scaffold and depending substantially perpendicularly away from a bottom of each another scaffold, each gusset engaging one of the another plurality of vertical beams when the another scaffold section is pivoted to the horizontal position.

8. The building as set forth in claim 7 wherein when the scaffold sections are extended vertically they provide clearance in the bay for a vehicle to be driven therein.

9. The building as set forth in claim 7 wherein each scaffold section is approximately 24 inches wide by 30 feet long.

10. The building as set forth in claim 7 wherein the means for pivotally supporting comprises a hinge.

11. The building as set forth in claim 7 wherein each scaffold section has associated therewith a hand rail affixed to the plurality of spaced vertical beams.

12. The building as set forth in claim 7 further comprising a staircase attached at a bottom end to the floor of the building and attached at a top end to one of the vertical beams and adapted to provide access to the scaffold sections.

13. A scaffold system comprising: a plurality of spaced vertical beams, each beam having a bottom end and a top end and adapted to be supported at the bottom end on a floor of a building; at least one first scaffold section extending across at least a first two of the plurality of spaced vertical beams; and at least one second scaffold section extending across at least a second two of the plurality of spaced vertical beams; the first and second scaffold sections having means on a proximal side and at opposite ends for pivotally supporting the first and the second scaffold sections respectively to the first two and the second two of the plurality of spaced vertical beams and at least two air cylinders for each of the first and the second scaffold sections connected respectively between the first and the second scaffold sections and between the top end and the bottom end of the at least first two of the vertical beams and between the top end and the bottom end thereof the at least second two of the vertical beams, each of the at least two air cylinders being adapted to be actuated between a lowered and a raised position, a distal side of each of the scaffold sections being pivoted away from the vertical beams when the at least two air cylinders are actuated to the lowered position to provide a substantially horizontal surface and the scaffold sections being positioned substantially vertically against the beam when the at least two air cylinders are actuated to the raised position, and a gusset attached adjacent each of the opposite ends of the proximal side of each scaffold and depending substantially perpendicularly away from a bottom of each scaffold, each gusset engaging one of the vertical beams when the scaffold section is pivoted to the lowered position.

14. The scaffold system as set forth in claim 13 further comprising: another plurality of spaced vertical beams, each beam having a bottom end and a top end and aligned substantially parallel to the other plurality of spaced vertical beams and supported at the bottom end on the floor of the building; at least one another first scaffold section extending across at least a first two of the another plurality of spaced vertical beams; and at least one second another scaffold section extending across at least a second two of the another plurality of spaced vertical beams; the first and the second another scaffold sections having means at opposite ends for pivotally supporting the first and the second another scaffold sections respectively to the first and the second two of the another plurality of spaced vertical beams and at least another two air cylinders for each of the first and the second another scaffold sections connected respectively between the first and the second another scaffold sections and the top end and the bottom end of the at least first two of the another plurality of spaced vertical beams and the at least second two of the another vertical beams, each of the at least another two air cylinders being adapted to be actuated between a lowered and a raised position, a distal end of each of the another scaffold sections being pivoted away from the another plurality of spaced vertical beams when the at least another two air cylinders are actuated to the lowered position to provide a substantially horizontal surface and the distal side of each of the another scaffold sections being pivoted toward the another plurality of vertical beams when the at least another two air cylinders are actuated to the raised position to be positioned substantially vertically against the beam, and another gusset attached adjacent each of the opposite ends of the proximal side of each another scaffold and depending substantially perpendicularly away from a bottom of each another scaffold, each gusset engaging one of the another plurality of vertical beams when the another scaffold section is pivoted to the horizontal position.

15. The scaffold system as set forth in claim 14 wherein when the scaffold sections are extended vertically they provide clearance in a bay for a vehicle to be driven therein.

16. The scaffold system as set forth in claim 14 wherein the means for pivotally supporting comprises a hinge.

17. The scaffold system as set forth in claim 14 wherein each scaffold section has associated therewith a hand rail affixed to the plurality of spaced vertical beams.

18. The scaffold system as set forth in claim 14 further comprising a staircase attached at a bottom end to the floor of the building and attached at a top end to one of the vertical beams and adapted to provide access to the scaffold sections.

19. A scaffold system comprising: a first plurality of spaced vertical beams having a top end and a bottom end and adapted to be supported at the bottom end on a floor of a building; at least one first scaffold section extending across at least a first two of the first plurality of spaced vertical beams; at least one second scaffold section extending across at least a second two of the first plurality of spaced vertical beams, the first and second scaffold sections being pivotally supported on a proximal side and at opposite ends to the first and second two of the first plurality of spaced vertical beams and at least two air cylinders for each of the first and the second scaffold sections connected respectively between the first and the second scaffold sections and the top end and the bottom end of the at least first two of the first plurality of spaced vertical beams and the at least second two of the first plurality of spaced vertical beams, each of the at least two air cylinders being adapted to be actuated between a lowered and a raised position, a distal side of each of the scaffold sections being pivoted away from the first plurality of vertical beams when the at least two air cylinders are actuated to the lowered position to provide a substantially horizontal surface and the distal side of each of the scaffold sections being pivoted toward the vertical beams when the at least two air cylinders are actuated to the raised position to be positioned substantially vertically against the first plurality of vertical beams, and a gusset attached adjacent each of the opposite ends of the proximal side of each scaffold and depending substantially perpendicularly away from a bottom of each scaffold, each gusset engaging one of the vertical beams when the scaffold section is pivoted to the lowered position; a second plurality of spaced vertical beams, each beam having a bottom end and a top end and aligned substantially parallel to the first plurality of spaced vertical beams and adapted to be supported at the bottom end on the floor of a building; at least one third scaffold section extending across at least a first two of the second plurality of spaced vertical beams; and at least one fourth scaffold section extending across at least a second two of the second plurality of spaced vertical beams, the third and fourth scaffold sections being pivotally supported at opposite ends to the first and the second two of the second plurality of spaced vertical beams and at least two air cylinders for each of the third and the fourth scaffold sections connected respectively between the third and the fourth scaffold sections and the top end and the bottom end of the at least first two of the second plurality of space vertical beams and the at least second two of the second plurality of spaced vertical beams, each of the at least two air cylinders being adapted to be actuated between a lowered and a raised position, a distal end of each of the third and fourth scaffold sections being pivoted away from the second plurality of spaced vertical beams when the at least two air cylinders are actuated to the lowered position to provide a substantially horizontal surface and the distal side of each of the third and fourth scaffold sections being pivoted toward the second plurality of spaced vertical beams when the at least two air cylinders are actuated to the raised position to be positioned substantially vertically against the second plurality of spaced vertical beams, and another gusset attached adjacent each of the opposite ends of the proximal side of each of the third and fourth scaffolds and depending substantially perpendicularly away from a bottom of each of the third and fourth scaffolds, each gusset engaging one of the second plurality of spaced vertical beams when the another scaffold section is pivoted to the horizontal position; each of the scaffold sections being extendable vertically to provide clearance in a bay for a vehicle to be driven therein, and each scaffold section having associated therewith a hand rail affixed to the plurality of spaced vertical beams.

20. The scaffold system as set forth in claim 19 further comprising a pair of staircases, where one is attached at a bottom end to the floor of the building and attached at a top end to one of the first plurality of vertical beams and adapted to provide access to the first and second scaffold sections, and where the other is attached at a bottom end to the floor of the building and attached at a top end to one of the second plurality of vertical beams and adapted to provide access to the third and fourth scaffold sections.

* * * * *